US008055163B2

(12) United States Patent
Kurimoto et al.

(10) Patent No.: US 8,055,163 B2
(45) Date of Patent: Nov. 8, 2011

(54) TONER REPLENISHING APPARATUS AND IMAGE FORMING APPARATUS

(75) Inventors: Hideaki Kurimoto, Osaka (JP); Koichi Mihara, Osaka (JP); Toshihide Ohgoshi, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 204 days.

(21) Appl. No.: 12/464,565

(22) Filed: May 12, 2009

(65) Prior Publication Data

US 2009/0285605 A1 Nov. 19, 2009

(30) Foreign Application Priority Data

May 14, 2008 (JP) ..... P2008-127758

(51) Int. Cl.
*G03G 15/08* (2006.01)

(52) U.S. Cl. ..... 399/263; 399/262

(58) Field of Classification Search ..... 399/258, 399/262, 263

See application file for complete search history.

(56) References Cited

U.S. PATENT DOCUMENTS 5,030,997 A * 7/1991 Michlin et al. ..... 399/263 X
5,235,389 A * 8/1993 Kikuchi et al. ..... 399/263
5,774,772 A 6/1998 Kai et al.
5,805,952 A * 9/1998 Buch et al. ..... 399/262 X
5,890,034 A * 3/1999 Nakano et al. ..... 399/262 X
6,424,812 B1 * 7/2002 Hsu ..... 399/262
7,796,925 B2 * 9/2010 Oda ..... 399/263

FOREIGN PATENT DOCUMENTS

JP 62-184471 A 8/1987
JP 09-062081 3/1997
JP 2000-147887 5/2000
JP 2002-182467 A 6/2002
JP 2003-233254 A 8/2003

* cited by examiner

*Primary Examiner* — Sandra Brase
(74) *Attorney, Agent, or Firm* — Nixon & Vanderhye, P.C.

(57) ABSTRACT

A toner replenishing apparatus is provided. The toner replenishing apparatus includes a toner replenishing container for replenishing toner stored therein to a developing section by a rotation of the container itself, a toner scraping member provided to be movable without being fixed in the toner replenishing container and to rub against an inner wall surface of the container, including a plurality of magnetic bodies arranged in a predetermined direction and a support section that extends in an arranging direction of the magnetic bodies and supports an one end portion of each of the magnetic bodies, and a magnet for attracting the magnetic bodies with a magnetic force, disposed along an outer peripheral surface of the toner replenishing container.

9 Claims, 7 Drawing Sheets

TONER REPLENISHING APPARATUS AND IMAGE FORMING APPARATUS

CROSS-REFERENCE TO RELATED APPLICATION

This application claims priority to Japanese Patent Application No. 2008-127758, which was filed on May 14, 2008, the contents of which are incorporated herein by reference in its entirety.

BACKGROUND OF THE INVENTION

1. Field of the Invention

The present invention relates to a toner replenishing apparatus for replenishing toner to a developing section for developing an electrostatic image on a surface of a photoreceptor with the toner, and an image forming apparatus including the toner replenishing apparatus.

2. Description of the Related Art

In a toner replenishment method in an image forming apparatus in which an electrostatic image on a surface of a photoreceptor is developed with toner to form an image on a recording medium, a toner replenishing container is firstly filled with the toner. Then, the toner filled in the toner replenishing container is replenished to a toner hopper and is supplied from the toner hopper to the electrostatic image on the surface of the photoreceptor. In the case of such an image forming apparatus, when a user thereof tills the toner replenishing container with the toner, there is a problem that a toner filling work tends to be troublesome since the toner sometimes adheres to a user's hand to soil it, and so on.

In order to solve such a problem, recently, a method has become a mainstream, in which method, when the toner to be supplied to the electrostatic image on the surface of the photoreceptor becomes insufficient, it is determined that the toner in the toner replenishing container is exhausted and the toner replenishing container itself is replaced with a new one, but in such a toner replenishing container, sometimes, the toner particles are aggregated to one another and get solidified due to the weight of the toner itself, resulting in that the toner may not be able to be replenished smoothly to the toner hopper and thus, there is a problem that it is impossible to completely use the toner in the toner replenishing container.

In order to prevent the toner particles in such a toner replenishing container from being aggregated to one another, a rotary toner replenishing container is practically in use, in which, with the toner replenishing container itself rotating, the toner is guided and transported by a spiral projection formed on an inner surface of the toner replenishing container and then replenished to the toner hopper. Such a rotary toner replenishing container is able to suppress aggregation of the toner in the toner replenishing container with the simple structure. However, the rotary toner replenishing container has a problem that the toner in the toner replenishing container adheres to the inner wall of the toner replenishing container and remains undischarged from the toner replenishing container.

For coping with such a problem, for example, Japanese Unexamined Patent Publication JP-A 2000-147887 discloses a rotary toner replenishing container provided with a spiral scraping member that rotates along an inner wall of the rotary toner replenishing container to scrape off toner adhering to the inner wall.

However, in the toner replenishing container disclosed in JP-A 2000-147887, when there remains a large quantity of toner in the toner replenishing container, frictional resistance between the spiral scraping member and the toner is so large that a drive torque required for rotating the toner replenishing container is also large, thereby a problem is posed that wear of driving components for the toner replenishing container and the scraping member itself are rapidly progressed.

SUMMARY OF THE INVENTION

An object of the invention is to provide a toner replenishing apparatus capable of, without increasing a drive torque required for rotating a toner replenishing container, scraping off toner adhering to the inner wall of the toner replenishing container in order to reduce a quantity of toner that remains undischarged from the toner replenishing container, and an image forming apparatus including the toner replenishing apparatus.

The invention provides a toner replenishing apparatus for replenishing toner to a developing section that develops with the toner an electrostatic image on a surface of a photoreceptor, comprising:

a toner replenishing container formed into a cylindrical shape, for replenishing the toner stored therein to the developing section by a rotation of the toner replenishing container itself;

a toner scraping member provided so as to be movable without being fixed in the toner replenishing container and to rub against an inner wall surface of the toner replenishing container, the toner scraping member including a plurality of magnetic bodies arranged in a predetermined direction and a support section that extends in an arranging direction of the magnetic bodies and supports an one end portion of each of the magnetic bodies; and a magnet disposed along an outer peripheral surface of the toner replenishing container, for attracting the magnetic bodies with a magnetic force.

According to the invention, there is provided a toner replenishing apparatus comprising a toner replenishing container for replenishing toner stored therein to a developing section by a rotation of the toner replenishing container itself, a toner scraping member provided so as to be movable without being fixed in the toner replenishing container and to rub against an inner wall surface of the toner replenishing container, the toner scraping member including a plurality of magnetic bodies arranged in a predetermined direction and a support section that extends in an arranging direction of the magnetic bodies and supports an one end portion of each of the magnetic bodies, and a magnet disposed along an outer peripheral surface of the toner replenishing container, for attracting the magnetic bodies with a magnetic force.

In the toner replenishing apparatus having such a structure, when the toner replenishing container is rotated, the magnetic body of the toner scraping member in the toner replenishing container is attracted by the magnetic force of the magnet disposed along the outer peripheral surface of the toner replenishing container. Accordingly, a frictional force is generated between the magnetic bodies and the inner wall surface of the toner replenishing container, thereby making it possible to scrape off the toner adhering to the inner wall surface of the toner replenishing container with the magnetic bodies. As a result, it is possible to reduce a quantity of toner that remains undischarged from the toner replenishing container.

Further, when there remains a large quantity of toner in the toner replenishing container, the toner scraping member is buried in the toner and rotated together with the toner, so that a force of attraction between the magnetic bodies of the toner scraping member and the magnet is reduced. Accordingly, it is possible to prevent frictional resistance between the toner scraping member and the toner in rotating the toner replenishing container from being increased. As a result, it is possible to prevent a drive torque required for rotating the toner replenishing container from being increased.

Meanwhile, when the quantity of the toner in the toner replenishing container becomes small, the magnetic bodies of the toner scraping member in the toner replenishing container are strongly attracted to the magnet disposed along the outer peripheral surface of the toner replenishing container with the magnetic force. Accordingly, the magnetic body can effectively scrape off the toner adhering to the inner wall surface of the toner replenishing container along with the rotation of the toner replenishing container, and thus it is possible to reduce the quantity of the toner that remains undischarged from the toner replenishing container.

Further, in the invention, it is preferable that the magnetic bodies are supported by the support section so as to be inclined at a predetermined angle relative to the arranging direction.

According to the invention, the magnetic bodies are supported by the support section so as to be inclined at a predetermined angle relative to the arranging direction. Thus the magnetic bodies can be attracted with the magnetic force of the magnet so as to scrape off the toner adhering to the inner wall surface of the toner replenishing container, as well as to guide and transport the toner contained in the toner replenishing container in a rotation axis direction of the toner replenishing container. Accordingly, without forming a member such as a so-called rib for guiding and transporting the toner on the inner wall surface of the toner replenishing container, it is possible to effectively transport the toner.

Further, in the invention, it is preferable that the magnetic bodies are each formed into a generally rectangular shape such that an other end portion with respect to the one end portion supported by the support section has a shape close to fit the inner wall surface of the toner replenishing container.

According to the invention, the magnetic bodies are each formed into a generally rectangular shape such that an other end portion with respect to the one end portion supported by the support section has a shape close to fit the inner wall surface of the toner replenishing container. As a result, when the magnetic bodies are attracted with the magnetic force of the magnet so as to scrape off the toner adhering to the inner wall surface of the toner replenishing container, the magnetic bodies contact and fit the inner wall surface of the toner replenishing container, thereby it is possible to scrape off the toner effectively. In addition, since the magnetic bodies are formed into the generally rectangular shape, there exist rectangular edges in all the surfaces. Accordingly, even when the toner scraping member is rotated in the toner replenishing container, the magnetic bodies can always scrape off the toner adhering to the inner wall surface of the toner replenishing container by the rectangular edge, so that a stable scrape effect is obtained.

Further, in the invention, it is preferable that the magnet is disposed along a portion extending so as to include lowermost points, in a rotary circumferential surface, of the outer peripheral surface of the toner replenishing container.

According to the invention, the magnet is disposed along a portion extending so as to include lowermost points, in a rotary circumferential surface of the outer peripheral surface, of the toner replenishing container. Thereby, when the quantity of the toner remaining in the toner replenishing container becomes small, the magnetic bodies move in a direction toward the lowermost points of the toner replenishing container due to the weight of the magnetic bodies so as to be reliably attracted to the magnet. Accordingly, when the quantity of the toner remaining in the toner replenishing container becomes small, the magnetic bodies attracted by the magnet are able to scrape off the toner adhering to the inner wall surface of the toner replenishing container reliably.

Further, in the invention, it is preferable that the magnetic bodies are made of ferrite.

According to the invention, the magnetic bodies are made of ferrite. Ferrite is a lightweight magnetic material with high saturation magnetization. Accordingly, even when the magnetic bodies in a state of being released from the magnetic force of the magnet are buried in the toner by the rotation of the toner replenishing container to be stirred and the magnetic bodies collide with the toner and the toner replenishing container, it is possible to reduce an impact force thereof and to prevent the toner replenishing container or the like from being damaged.

Further, in the invention, it is preferable that a surface of the toner scraping member is coated with resin.

According to the invention, a surface of the toner scraping member is coated with resin. Thereby, even when the toner scraping member in a state of being released from the magnetic force of the magnet is buried in the toner by the rotation of the toner replenishing container to be stirred and the toner scraping member collides with the toner and the toner replenishing container, it is possible to reduce an impact force thereof and to prevent the toner replenishing container or the like from being damaged.

Further, in the invention, it is preferable that the toner scraping member has a hollow structure.

According to the invention, the toner scraping member has a hollow structure. Thereby, an apparent specific gravity of the toner scraping member as a whole becomes so small that it is possible to prevent the magnetic bodies buried in the toner within the toner replenishing container from being sunk deep into the toner. Accordingly, the toner scraping member moves easily together with the toner, and when there remains a large quantity of toner in the toner replenishing container, it is possible to prevent the frictional resistance between the toner scraping member and the toner in rotating the toner replenishing container from being increased. As a result, it is possible to prevent the drive torque required for rotating the toner replenishing container from being increased. In addition, when the quantity of the toner remaining in the toner replenishing container becomes small, the magnetic bodies of the toner scraping member can be restrained by the magnetic force of the magnet so as to scrape off the toner adhering to the inner wall surface of the toner replenishing container.

In the invention, it is preferable that the toner scraping member has a specific gravity of 0.2 or more and 0.3 or less.

According to the invention, the toner scraping member has a specific gravity of 0.2 or more and 0.3 or less. In this way, when the toner scraping member having the specific gravity smaller than that of the toner is buried in the toner within the toner replenishing container, a buoyant force is generated in the toner. Accordingly, the toner scraping member easily moves together with the toner, and when there remains a large quantity of toner in the toner replenishing container, it is possible to prevent the frictional resistance between the toner scraping member and the toner in rotating the toner replenishing container from being increased. As a result, it is possible to prevent the drive torque required for rotating the toner replenishing container from being increased. In addition, when the quantity of the toner remaining in the toner replenishing container becomes small, the magnetic bodies of the toner scraping member can be restrained by the magnetic force of the magnet so as to scrape off the toner adhering to the inner wall surface of the toner replenishing container.

The invention provides an image forming apparatus, comprising:

a photoreceptor on a surface of which an electrostatic image is to be formed;

a charging section for charging the surface of the photoreceptor;

an exposure section for irradiating the surface of the photoreceptor in a charged state with signal light based on image information to form the electrostatic image;

a developing section for developing the electrostatic image on the surface of the photoreceptor to form a toner image;

the above-described toner replenishing apparatus for replenishing toner to the developing section;

a transfer section for transferring the toner image to a recording medium; and a fixing section for fixing the toner image transferred to the recording medium.

According to the invention, an image forming apparatus includes the toner replenishing apparatus capable of preventing the drive torque required for rotating the toner replenishing container from being increased when there remains a large quantity of toner in the toner replenishing container, and capable of efficiently scraping off the toner adhering to the inner wall surface of the toner replenishing container when the quantity of the toner remaining in the toner replenishing container becomes small. As a result, the image forming apparatus can form an image on the recording medium in a state where the toner can be replenished efficiently to the developing section for developing with the toner the electrostatic image on the surface of the photoreceptor.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
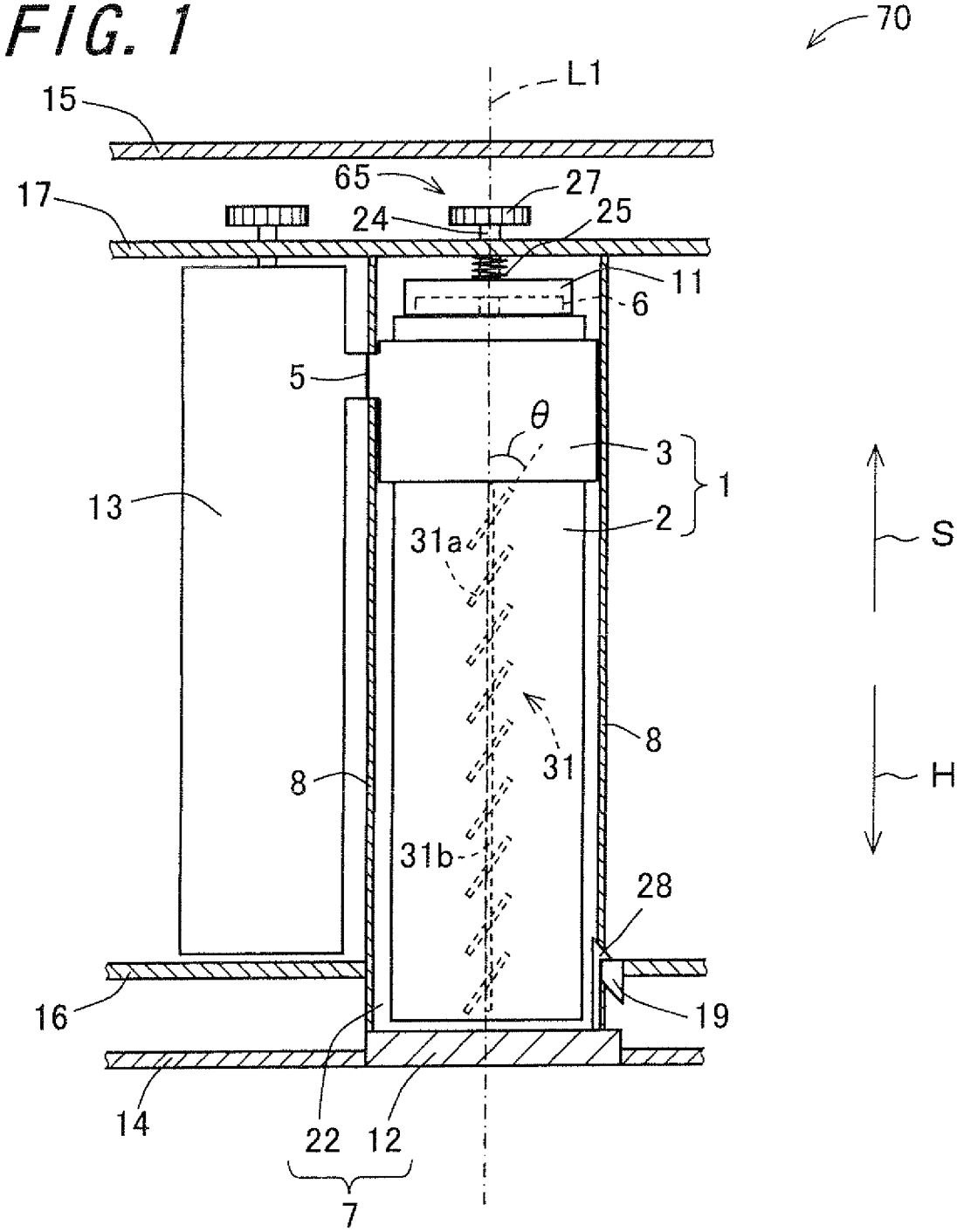
FIG. 1 is a top view showing the structure of a toner replenishing apparatus according to an embodiment of the invention.

Now referring to the drawings, preferred embodiments of the invention are described below.

Figure 2:
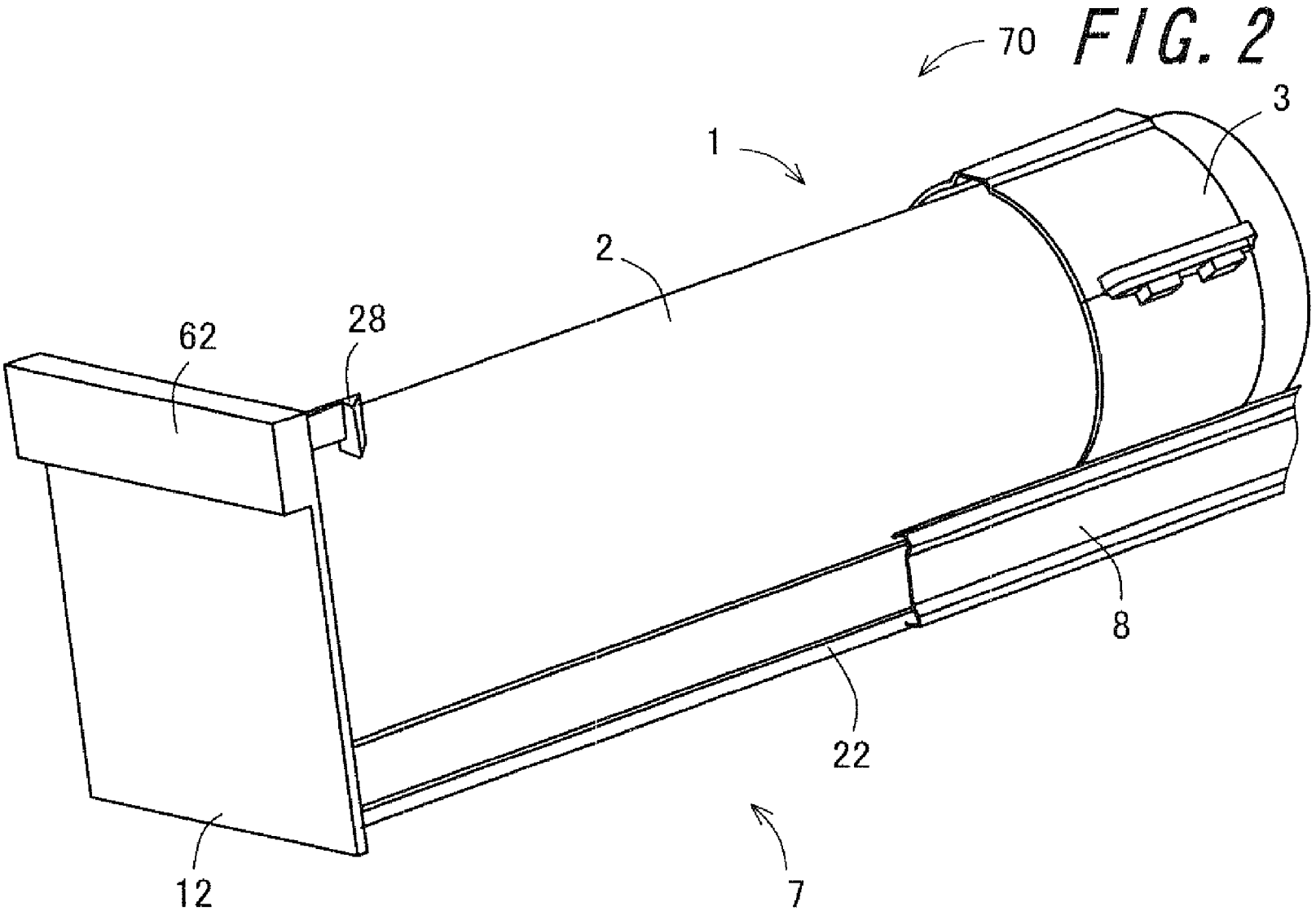
FIG. 2 is a perspective view showing the structure of the toner replenishing apparatus.
Figure 3:
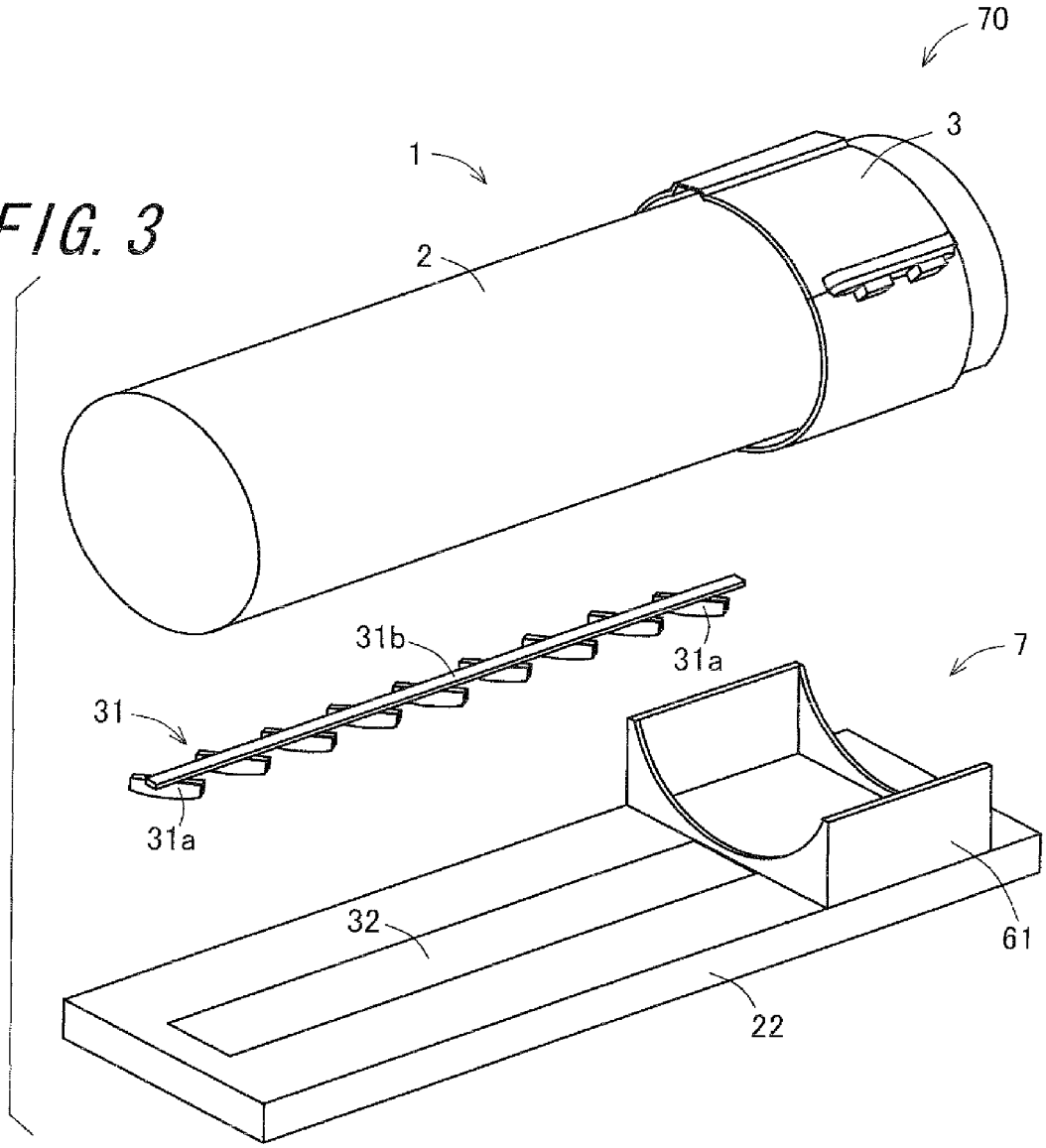
FIG. 3 is an exploded perspective view showing the structure of the toner replenishing apparatus.
Figure 4:
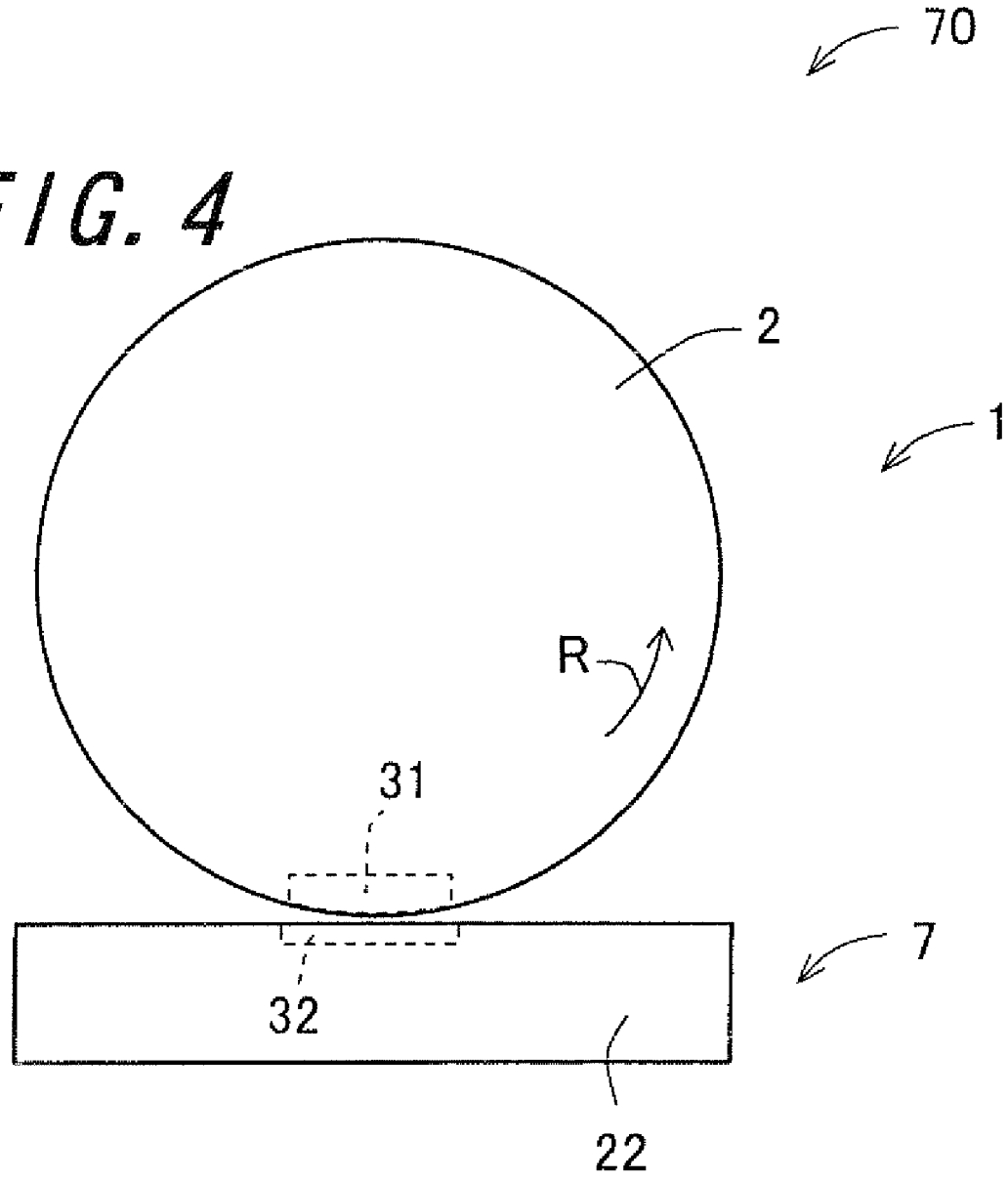
FIG. 4 is a front view showing the structure of the toner replenishing apparatus.
Figure 5:
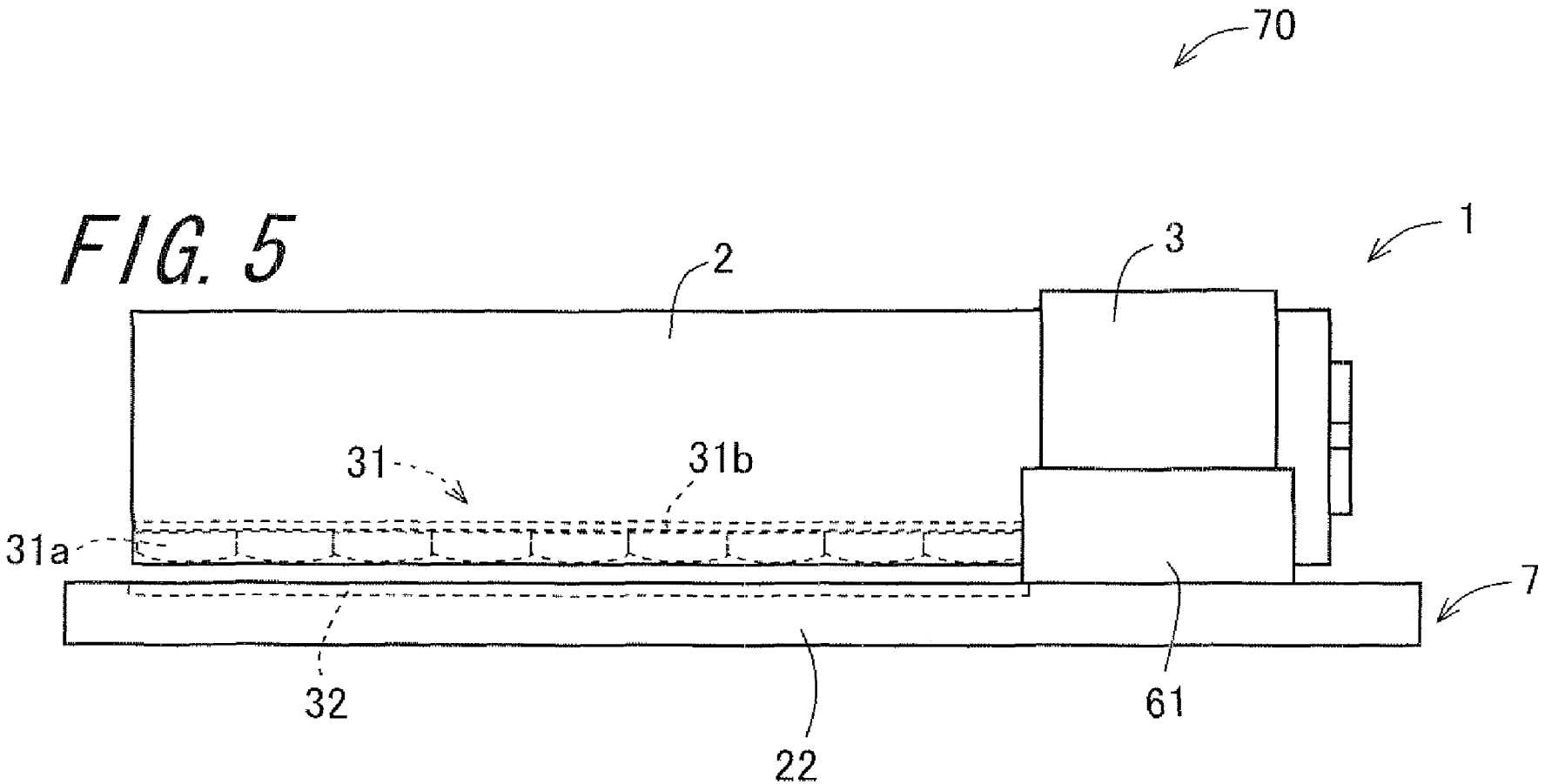
FIG. 5 is a side view showing the structure of the toner replenishing apparatus.
Figure 6:
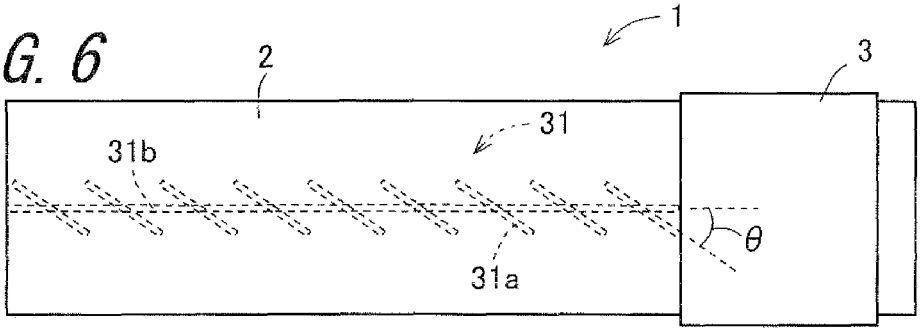
FIG. 6 is a top view showing the structure of the toner replenishing container.
Figure 7:
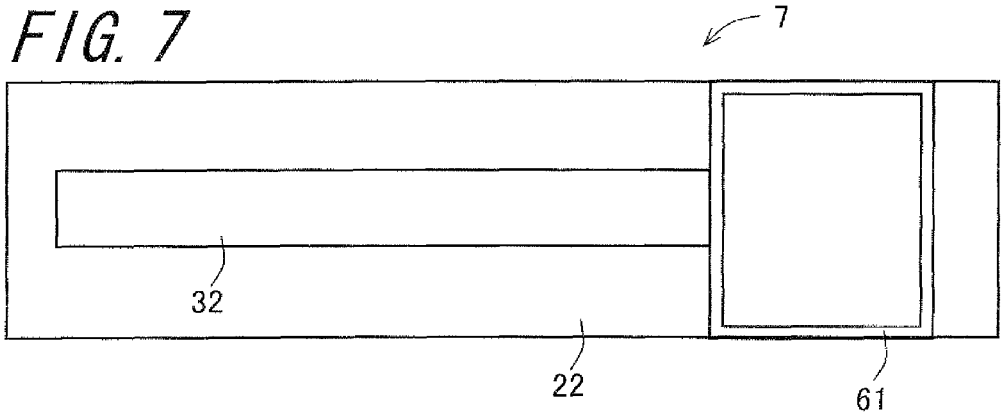
FIG. 7 is a top view showing the structure of a container holding member.

FIG. 1 is a top view showing the structure of a toner replenishing apparatus 70 according to an embodiment of the invention. FIG. 2 is a perspective view showing the structure of the toner replenishing apparatus 70. FIG. 3 is an exploded perspective view showing the structure of the toner replenishing apparatus 70. FIG. 4 is a front view showing the structure of the toner replenishing apparatus 70. FIG. 5 is a side view showing the structure of the toner replenishing apparatus 70. FIG. 6 is a top plan view showing the structure of a toner replenishing container 1. FIG. 7 is a top plan view showing the structure of a container holding member 7.

The toner replenishing apparatus 70 is an apparatus for replenishing toner to a developing section 47 provided in an image forming apparatus 100 described below. The toner replenishing apparatus 70 is disposed horizontally adjacent to the developing section 47 in the image forming apparatus 100 described below. In addition, the toner replenishing apparatus 70 includes a toner replenishing container 1, a container holding member 7, and a toner hopper 13.

The toner replenishing container 1 has a toner containing section 2 and a supporting member 3. The toner containing section 2 is formed into a cylindrical shape and contains the toner therein. In addition, the toner containing section 2 is rotated around a rotation axis line L1 of a rotation shaft 24 by a driving force transmission mechanism 65 described below, and is constituted so as to replenish the toner contained therein to the toner hopper 13 described below by a rotation of the toner containing section 2 itself.

Further, the toner containing section 2 has a through hole 5 and a container-side coupling section 6. The through hole 5 is an opening formed on a side wall of the toner containing section 2, and the toner contained in the toner containing section 2 is replenished through the through hole 5 to the toner hopper 13 along with the rotation of the toner containing section 2. The container-side coupling section 6 is a portion that receives a rotary driving force transmitted from a main body of the image forming apparatus through a main body-side coupling section 11 included in a driving force transmission mechanism 65 described below. In addition, as described below in detail, a toner scraping member 31 in the embodiment is constituted so as to guide and transport the toner, so that there is no need to form a toner guide projection (rib) on an inner peripheral surface of the toner containing section 2. The toner containing section 2 in which the toner guide projection is not formed can be manufactured in a short molding time and with reduced manufacturing cost, further, the strength of the toner containing section 2 itself can be increased.

The supporting member 3 supports the toner containing section 2 rotatably around the rotation axis line L1, and supports a part of an outer peripheral surface of the toner containing section 2 so as to cover over the whole circumference.

The toner hopper 13 is a container for reserving the toner replenished from the toner replenishing container 1 through the through hole 5. The toner is supplied from the toner hopper 13 to the developing section 47 in the image forming apparatus 100.

The container holding member 7 fixes and holds the toner replenishing container 1 at a specified position in the container holding member 7. The container holding member 7 includes a bottom wall section 22 and a container fixing section 61.

The bottom wall section 22 extends in a direction in which the rotation axis line L1 extends, in accordance with the toner replenishing container 1, and constitutes a base part on which the toner replenishing container 1 is disposed. The container fixing section 61 is provided on the bottom wall section 22, and detachably holds the supporting member 3 of the toner replenishing container 1 disposed on the bottom wall section 22 to fix the toner replenishing container 1 so that the toner replenishing container 1 does not move in the direction in which the rotation axis line L1 extends.

Hereinafter, description will be given for a position at which the bottom wall section 22 is disposed in the image forming apparatus 100 described below, that is, a position at which the toner replenishing container 1 to be mounted to the bottom wall section 22 is disposed. In the image forming apparatus 100, a housing is disposed inside an exterior section forming an outer peripheral of the image forming apparatus 100, and various sections such as the developing section 47 are installed in the housing. The exterior section has, as shown in FIG. 1, a front exterior section 14 and a rear exterior section 15 facing each other. The front exterior section 14 is a portion positioned just in front of a user of the image forming apparatus 100. Also, the rear exterior section 15 is a portion corresponding to a rear side of the image forming apparatus 100 when viewed from the user in a side of the front exterior section 14. In addition, the housing disposed inside the exterior section has a housing front section 16 facing the front exterior section 14 and a housing rear section 17 facing the rear exterior section 15.

The bottom wall section 22 of the container holding member 7 that fixes and holds the toner replenishing container 1 has both ends thereof in the direction in which the rotational axis line L1 extends, the one end in a side where the container fixing section 61 is provided being connected to the housing rear section 17 and the other end being connected through the housing front section 16 to a front wall section 12 that is a part of the front exterior section 14.

In addition, the front wall section 12 is formed with a handle 62 at a front thereof, and the bottom wall section 22 is further provided with two guide members 8 in the direction in which the rotation axis line L1 extends. The guide members 8 can be expanded and contracted in the direction in which the rotation axis line L1 extends, and when the guide members 8 are expanded and contracted, the toner replenishing container 1 fixed to the bottom wall section 22 is allowed to move in the direction in which the rotation axis line L1 extends.

When the user in the side of the front exterior section 14 pulls the handle 62 formed on the front wall section 12 in a pull-out direction H, the toner replenishing container 1 fixed to the bottom wall section 22 of the container holding member 7 is able to be pulled out to a position outward of the front exterior section 14. Accordingly, it is possible to easily pull out the used toner replenishing container 1. In addition, the user can attach a new toner replenishing container 1 to the container holding member 7 and then push the handle 62 in a direction S from the front exterior section 14 toward the rear exterior section 15, thereby placing the new toner replenishing container back in an original position.

Further, the front wall section 12 connected to the bottom wall section 22 of the container holding member 7 is formed with a hook member 28, and the housing front section 16 is formed with an engagement member 19. The hook member 28 and the engagement member 19 are provided so that, in a state where the toner replenishing container 1 is fixed to the container holding member 7 and the container holding member 7 is fully housed, the hook member 28 is engaged with the engagement member 19. Thereby, it is possible to reliably maintain the housed state of the toner replenishing container 1 fixed to the container holding member 7. Note that the arrangement positions of the hook member 28 and the engagement member 19 are not limited to the above, but the hook member 28 may be provided on the housing front section 16 and the engagement member 19 may be provided on the front wall section 12.

Further, the driving force transmission mechanism 65 is provided at a position facing the toner replenishing container 1 in the housing rear section 17. The driving force transmission mechanism 65 transmits the rotary driving force to the toner containing section 2, and includes the main body-side coupling section 11, the rotation shaft 24, a pressure spring 25, and a gear 27. The rotation shaft 24 serves as a shaft for the rotation of the toner containing section 2, and penetrates the housing rear section 17. A bearing section (not shown) is provided at a position of the housing rear section 17 in the rotation shaft 24 to allow the rotation shaft 24 to rotate freely.

The main body-side coupling section 11 is formed into a generally disc shape, and is fixed to the rotation shaft 24 so as to be capable of being rotated around the rotation axis line L1 integrally together with the rotation shaft 24. Formed on a surface in the main body-side coupling section 11, which surface is in contact with the toner containing section 2, is a cross-shaped fitting recessed section into which the container-side coupling section 6 of the toner containing section 2 can be fitted. The pressure spring 25 made of a coil spring is disposed between the housing rear section 17 and the main body-side coupling section 11, and applies a spring force in a direction in which the main body-side coupling section 11 is separated from the housing rear section 17, without inhibiting the rotation of the rotation shaft 24 and the main body-side coupling section 11. The gear 27 is fixed to an end at an opposite side to the main body-side coupling section 11 in the rotation shaft 24. The driving force for causing the toner containing section 2 to rotate is transferred from a driving source of the image forming apparatus 100 to the gear 27.

Next, description will be given for the toner scraping member 31 and a magnet 32 as the characteristic structure in the toner replenishing apparatus 70. The magnet 32 has a rectangular shape, which is fixed to the bottom wall section 22 along an outer peripheral surface of the toner replenishing container 1 in the direction in which the rotation axis line L1 of the toner containing section 2 extends, and attracts magnetic bodies 31*a* of the toner scraping member 31 described below provided in the toner containing section 2 with a magnetic force.

When the toner containing section 9 is rotated around the rotation axis line L1, the force of the magnet 32 (magnetic force) tending to hold the magnetic bodies 31*a* of the toner scraping member 31 at a nearest position is exerted, resulting in that there arises a speed difference between the toner scraping member 31 and an inner wall surface of the toner containing section 2. Accordingly, the magnetic bodies 31*a* of the toner scraping member 31 rub against the inner wall surface of the toner containing section 2. This rubbing force enables to scrape off the toner adhering to the inner wall surface of the toner containing section 2, which makes it possible to reduce the toner adhering to the inner wall surface of the toner containing section 2. Thereby, it is possible to reduce the quantity of the toner that remains undischarged from the toner containing section 2.

Further, when there remains a large quantity of toner in the toner containing section 2, a force of attraction between the magnetic bodies 31*a* of the toner scraping member 31 buried in the toner and the magnet 32 is reduced, which makes it possible to prevent frictional resistance between the toner scraping member 31 and the toner in rotating the toner containing section 2 from being increased. As a result, it is possible to prevent a drive torque required for rotating the toner containing section 2 from being increased and to prevent driving components for the toner containing section 2 from wearing.

Further, when the quantity of the toner in the toner containing section 2 becomes small, the magnetic bodies 31*a* of the toner scraping member 31 are strongly attracted to the magnet 32 with the magnetic force. Accordingly, the magnetic bodies 31*a* can effectively scrape off the toner adhering to the inner wall surface of the toner containing section 2 along with the rotation of the toner containing section 2, and thus it is possible to reduce the quantity of the toner that remains undischarged from the toner containing section 2.

Although the position at which the magnet 32 is disposed is not particularly limited as far as the position is close to the outer peripheral surface of the toner containing section 2, in the embodiment, the magnet 32 is disposed along a portion extending so as to include lowermost points, in a rotary circumferential surface, of the outer peripheral surface of the toner containing section 2. Thereby, when the quantity of the toner remaining in the toner containing section 2 becomes small, the toner scraping member 31 moves in a direction toward the lowermost points of the toner containing section 2 due to the weight of the magnetic bodies 31*a* so as to be reliably attracted to the magnet 32. Accordingly, when the quantity of the toner remaining in the toner containing section 2 becomes small, the toner scraping member 31 attracted by the magnet 32 is able to scrape off the toner adhering to the inner wall surface of the toner containing section 2 reliably.

The toner scraping member 31, which is provided so as to be movable without being fixed in the toner containing section 2, includes a support section 31*b* and a plurality of magnetic bodies 31*a*. The length of the toner scraping member 31 in a longitudinal direction (an arranging direction of the magnetic bodies 31*a* described below) is adapted to be slightly shorter, that is, from 80% to 98%, relative to the length of the toner containing section 2 in a longitudinal direction. When the length is below 80%, the toner adhering to the inner wall surface of the toner containing section 2 tends to be remained unscraped, and when the length is above 98%, the toner scraping member 31 tends to get lodged in the toner containing section 2, and thus it becomes difficult to scrape off the toner smoothly.

The support section 31*b* is a member which extends in the arranging direction of the plurality of magnetic bodies 31*a* and supports an one end portion of each of the magnetic bodies 31*a* in the toner scraping member 31. The toner scraping member 31 is disposed in the toner containing section 2 such that an extending direction of the support section 31*b* (the arranging direction of the magnetic bodies 31*a*) is approximately parallel to the direction in which the rotation axis line L1 of the toner replenishing container 1 extends. A material making up the support section 31*b* is, for example, non-magnetic metal material, resin or the like, but not particularly limited as far as the material is not magnetic. The support section 31*b* preferably has a hollow structure in order to get a buoyant force in the toner (or in order to lower a specific gravity).

The plurality of magnetic bodies 31*a* are formed so as to be arranged throughout the support section 31*b*, in which an one end portion of each of the magnetic bodies 31*a* is fixed to and supported by the support section 31*b*. In the invention, when the plurality of magnetic bodies 31*a* are attracted with the magnetic force of the magnet 32, the plurality of magnetic bodies 31*a* rub against the inner wall surface of the toner containing section 2 so as to scrape off the toner adhering to the inner wall surface of the toner containing section 2.

Further, it is preferable that the plurality of magnetic bodies 31*a* are supported by the support section 31*b* so as to be inclined at a predetermined angle θ relative to the arranging direction. Thereby, each of the magnetic bodies 31*a* can be attracted with the magnetic force of the magnet 32 so as to scrape off the toner adhering to the inner wall surface of the toner containing section 2, as well as to guide and transport the toner contained in the toner containing section 2 toward the through hole 5. Accordingly, without forming a member such as a so-called rib for guiding and transporting the toner on the inner wall surface of the toner containing section 2, it is possible to effectively transport the toner.

In the embodiment, the angle θ at which the magnetic bodies 31*a* are supported by the support section 31*b* is the same with respect to all the magnetic bodies 31*a* and is set at 45°, however, the angle θ may be basically set between 30° and 60°. When the angle θ is below 30°, the transporting ability of the toner by the magnetic bodies 31*a* becomes too low. Meanwhile, when the angle θ is above 60°, the transport velocity of the toner by the magnetic bodies 31*a* becomes too low.

Further, the angle θ at which the magnetic bodies 31*a* are supported by the support section 31*b* may be set larger as the magnetic body 31*a* is closer to the through hole 5 which is the opening for discharging the toner, within a range of angel variation from 0° to 15°. In that case, the angle θ corresponding to each of the plurality of magnetic bodies 31*a* is set such that a difference of the angle θ between the magnetic bodies 31*a* adjacent to each other is within a range from 0° to 5°. Herein, the angle θ corresponding to each of the plurality of magnetic bodies 31*a* may be varied one by one, or may be set such that some of the magnetic bodies 31*a* have the same angle. Accordingly, it is possible to increase the transporting ability of the toner along with the scraping ability of the adhering toner by the magnetic bodies 31*a* according as the magnetic body 31*a* is closer to the through hole 5.

Further, in the arrangement of the plurality of magnetic bodies 31*a* supported by the support section 31*b*, a distance between the magnetic bodies 31*a* adjacent to each other (DJ) is set as $DJ=LJ\cdot\cos\theta$, in relation to the length of the magnetic body 31*a* (LJ).

As to the shape of each magnetic body 31*a*, there is no particular limitation, but in the embodiment, the magnetic body 31*a* is formed into a generally rectangular shape such that an other end portion with respect to the one end portion supported by the support section 31*b* has a shape close to fit the inner wall surface of the toner containing section 2. As a result, when the magnetic body 31*a* is attracted with the magnetic force of the magnet 32 so as to scrape off the toner adhering to the inner wall surface of the toner containing section 2, the magnetic body 31*a* contacts and fits the inner wall surface of the toner containing section 2, thereby it is possible to scrape off the toner effectively. In addition, since the magnetic bodies 31*a* are formed into the generally rectangular shape, there exist rectangular edges in all the surfaces. Accordingly, even when the toner scraping member 31 is rotated in the toner containing section 2, the magnetic body 31*a* can always scrape off the toner adhering to the inner wall surface of the toner containing section 2 by the rectangular edge, so that a stable scrape effect is obtained.

Further, the size of each magnetic body 31*a* is not particularly limited, but it is preferable that the length of each magnetic body 31*a* supported by the support section 31*b* in a longitudinal direction is set to be 5 to 30% relative to the inner diameter of the toner containing section 2. When the length of each magnetic body 31.*a* in the longitudinal direction is smaller than 5% relative to the inner diameter of the toner containing section 2, a force for scraping off the toner adhering to the inner wall surface of the toner containing section 2 by each magnetic body 31*a* becomes too small, and when exceeding 30%, each magnetic body 31*a* is so large that the frequency of contacting the inner wall surface of the toner containing section 2 is reduced, and thus reducing the effect of scraping off the toner.

Further, in the embodiment, each of the magnetic body 31*a* is made of ferrite. Ferrite is a lightweight magnetic body with high saturation magnetization. Accordingly, even when the magnetic bodies 31*a* of the toner scraping member 31 in a state of being released from the magnetic force of the magnet 32 are buried in the toner by the rotation of the toner containing section 2 to be stirred and the toner scraping member 31 collides with the toner and the inner wall surface of the toner containing section 2, it is possible to reduce an impact force thereof and to prevent the inner wall surface of the toner containing section 2 or the like from being damaged.

Further, it is preferable that a surface of the toner scraping member 31 that comprises the magnetic bodies 31*a* and the support section 31*b* is coated with resin. Thereby, even when the toner scraping member 31 in a state of being released from the magnetic force of the magnet 32 is mixed in the toner by the rotation of the toner containing section 2 to be stirred and the toner scraping member 31 collides with the toner and the inner wall surface of the toner containing section 2, it is possible to reduce an impact force thereof and further to prevent the inner wall surface of the toner containing section 2 or the like from being damaged.

Further, it is preferable that the toner scraping member 31 has a hollow structure. Thereby, an apparent specific gravity of the toner scraping member 31 as a whole becomes so small that it is possible to prevent the toner scraping member 31 buried in the toner within the toner containing section 2 from being sunk deep into the toner. Accordingly, the toner scraping member 31 moves easily together with the toner, and when there remains a large quantity of toner in the toner containing section 2, it is possible to prevent the frictional resistance between the toner scraping member 31 and the toner in rotating the toner replenishing container 2 from being increased. As a result, it is possible to prevent the drive torque required for rotating the toner containing section 2 from being increased. In addition, when the quantity of the toner remaining in the toner containing section 2 becomes small, the magnetic bodies 31*a* of the toner scraping member 31 can be restrained by the magnetic force of the magnet 32 so as to scrape off the toner adhering to the inner wall surface of the toner containing section 2.

Further, it is preferable that the toner scraping member 31 has a specific gravity of 0.2 or more and 0.3 or less. In this way, when the toner scraping member 31 having the specific gravity smaller than that of the toner is buried in the toner within the toner containing section 2, a buoyant force is generated in the toner. Accordingly, the toner scraping member 31 easily moves together with the toner, and when there remains a large quantity of toner in the toner containing section 2, it is possible to prevent the frictional resistance between the toner scraping member 31 and the toner in rotating the toner replenishing container 2 from being increased. As a result, it is possible to prevent the drive torque required for rotating the toner containing section 2 from being increased. In addition, when the quantity of the toner remaining in the toner containing section 2 becomes small, each of the magnetic bodies 31*a* of the toner scraping member 31 can be restrained by the magnetic force of the magnet 32 so as to scrape off the toner adhering to the inner wall surface of the toner containing section 2.

Figure 8:
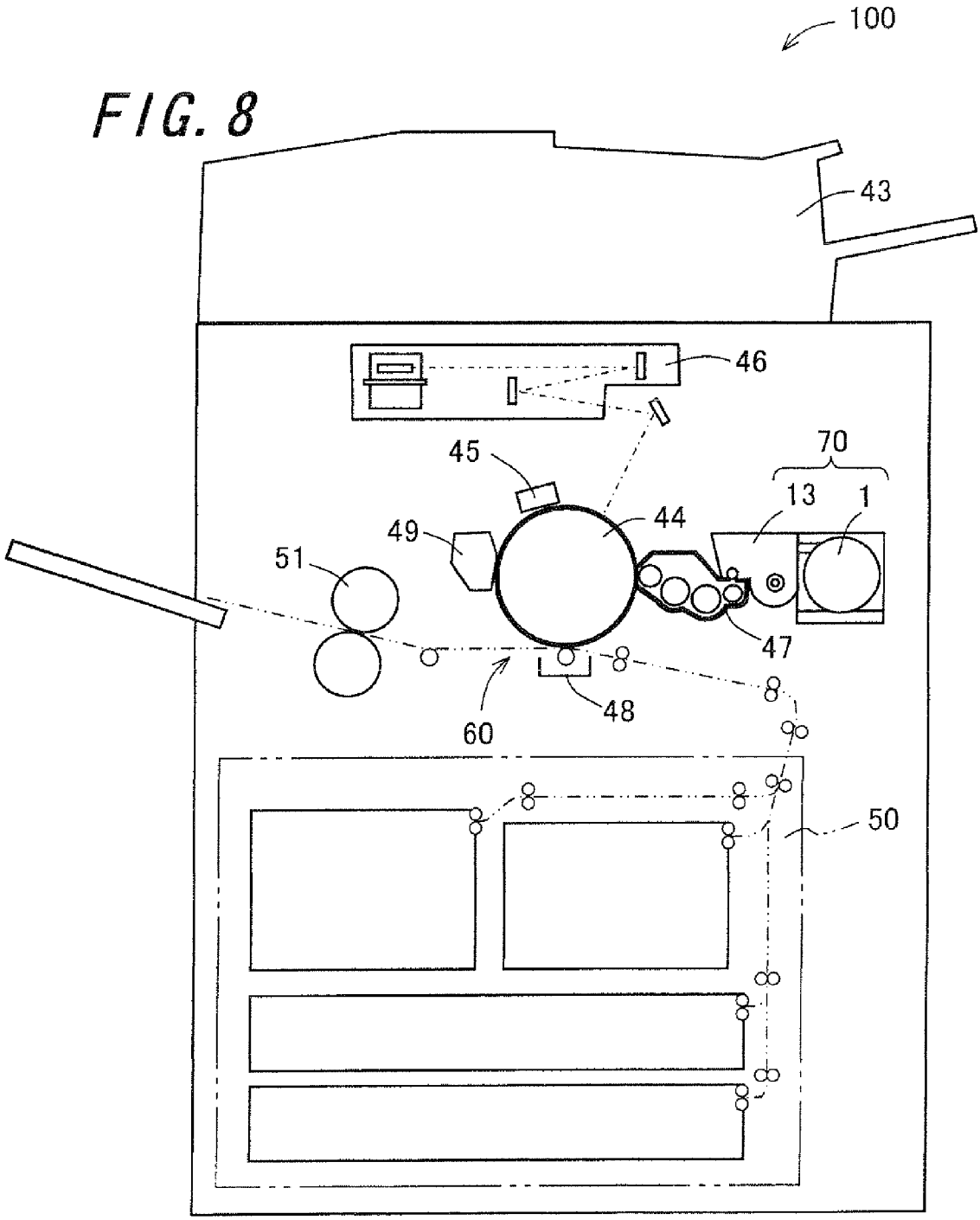
FIG. 8 is a front view showing the structure of the image forming apparatus according to an embodiment of the invention.

FIG. 8 is a front view showing the structure of the image forming apparatus 100 according to an embodiment of the invention. The image forming apparatus 100 is an apparatus for forming an image on a surface of a recording medium such as recording paper to obtain a printed matter. The image forming apparatus 100 includes an electrophotographic process section 60 and a sheet supply section 50. The electrophotographic process section 60 includes a photoreceptor drum 44, a charging section 45, an exposure section 46, a developing section 47, a transfer section 48, a cleaning section 49, and a fixing section 51, and forms an image on the surface of the recording medium supplied from the sheet supply section 50.

The photoreceptor drum 44 is supported so as to be rotatable around an axis thereof by a driving section (not shown) and includes a cylindrical or columnar conductive substrate (not shown) and a photosensitive layer formed on a surface of the conductive substrate. As the photoreceptor drum 44, a photoreceptor drum commonly used in this field may be used, and an example thereof includes one containing an aluminum pipe as the conductive substrate and an organic photosensitive layer formed on a surface of the aluminum pipe. The organic photosensitive layer is formed by laminating a charge generating layer containing a charge generating substance and a charge transporting layer containing a charge transporting substance. The organic photosensitive layer may include the charge generating substance and the charge transporting substance in one layer.

The charging section 45 charges a surface of the photoreceptor drum 44 with a predetermined polarity and at a predetermined potential. In the embodiment, a charging roller is used as the charging section 45, but without limitation thereto, for example, it is possible to use a brush-type charging device, a charger-type charging device, a corona charging device such as a scorotron charger, or the like. The exposure section 46 irradiates the surface of the photoreceptor drum 44 in a charged state with signal light corresponding to image information of a document read by a scanner 43, and forms an electrostatic image corresponding to the image information on the surface of the photoreceptor drum 44. For the exposure section 46, a laser beam scanner or the like is used.

The developing section 47 supplies toner to the electrostatic image on the surface of the photoreceptor drum 44 and develops the electrostatic image to form a toner image. At this time, depending on a toner consumption quantity in the developing section 47, the toner is replenished from the toner hopper 13 of the toner replenishing apparatus 70 described above. The transfer section 48 is brought into pressure-contact with the surface of the photoreceptor drum 44, and, in synchronization with arrival of the toner image on the photoreceptor drum 44 at the pressure-contact portion of the photoreceptor drum 44 and the transfer section 48, transfers the toner image on the surface of the photoreceptor drum 44 onto the recording medium conveyed from the sheet supply section 50 described below to the pressure-contact portion of the photoreceptor drum 44 and the transfer section 48, by applying pressure. For the transfer section 48, for example, a transfer roller is used.

The fixing section 51 fixes the toner image transferred onto the recording medium by the transfer section 48 to the recording medium with heat and pressure. The cleaning section 49 is provided so as to be brought into contact with the surface of the photoreceptor drum 44, and removes the toner, paper powder or the like remaining on the surface of the photoreceptor drum 44 after the toner image is transferred to the recording medium, to clean up the surface of the photoreceptor drum 44.

According to the electrophotographic process section 60, after charging, by the charging section 45, the surface of the photoreceptor drum 44 rotating around the axis thereof, the signal light corresponding to the image information is irradiated by the exposure section 46 to from the electrostatic image. Then, the developing section 47 supplies the toner replenished from the toner replenishing apparatus 70 to the electrostatic image to obtain the toner image, and the toner image is transferred to the recording medium by the transfer section 48. The toner image is fixed to the recording medium by applying the heat and pressure by means of the fixing section 51. The recording medium having the image formed thereon in this way is fed to outside the image forming apparatus 100. Meanwhile, the surface of the photoreceptor drum 44 after transfer of the toner image is cleaned by the cleaning section 49. The series of processes is repeated to form the image.

The sheet supply section 50 includes a sheet cassette for storing recording media and a sheet feed path serving as a passage in which the recording medium is conveyed. The recording medium stored in the sheet cassette is conveyed along the sheet feed path to the contact portion of the photoreceptor drum 44 and the transfer section 48 in the electrophotographic process section 60 and then conveyed to the fixing section 51.

The image forming apparatus 100 includes the toner replenishing apparatus 70 capable of preventing the drive torque required for rotating the toner containing section 2 from being increased when there remains a large quantity of toner in the toner containing section 2 of the toner replenishing container 1, and capable of efficiently scraping off the toner adhering to the inner wall surface of the toner containing section 2 when the quantity of the toner remaining in the toner containing section 2 becomes small. As a result, the image forming apparatus 100 can form an image on the recording medium in a state where the toner can be replenished efficiently to the developing section 47 for developing with the toner the electrostatic image on the surface of the photoreceptor drum 44.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A toner replenishing apparatus for replenishing toner to a developing section that develops with the toner an electrostatic image on a surface of a photoreceptor, comprising:

a toner replenishing container formed into a cylindrical shape, for replenishing the toner stored therein to the developing section by a rotation of the toner replenishing container itself;

a toner scraping member provided so as to be movable without being fixed in the toner replenishing container and to rub against an inner wall surface of the toner replenishing container, the toner scraping member including a plurality of magnetic bodies arranged in a predetermined direction and a support section that extends in an arranging direction of the magnetic bodies and supports an one end portion of each of the magnetic bodies; and a magnet disposed along an outer peripheral surface of the toner replenishing container, for attracting the magnetic bodies with a magnetic force.

2. The toner replenishing apparatus of claim 1, wherein the magnetic bodies are supported by the support section so as to be inclined at a predetermined angle relative to the arranging direction.

3. The toner replenishing apparatus of claim 1, wherein the magnetic bodies are each formed into a generally rectangular shape such that an other end portion with respect to the one end portion supported by the support section has a shape close to fit the inner wall surface of the toner replenishing container.

4. The toner replenishing apparatus of claim 1, wherein the magnet is disposed along a portion extending so as to include lowermost points, in a rotary circumferential surface, of the outer peripheral surface of the toner replenishing container.

5. The toner replenishing apparatus of claim 1, wherein the magnetic bodies are made of ferrite.

6. The toner replenishing apparatus of claim 1, wherein a surface of the toner scraping member is coated with resin.

7. The toner replenishing apparatus of claim 1, wherein the toner scraping member has a hollow structure.

8. The toner replenishing apparatus of claim 1, wherein the toner scraping member has a specific gravity of 0.2 or more and 0.3 or less.

9. An image forming apparatus, comprising:

a photoreceptor on a surface of which an electrostatic image is to be formed;

a charging section for charging the surface of the photoreceptor;

an exposure section for irradiating the surface of the photoreceptor in a charged state with signal light based on image information to form the electrostatic image;

a developing section for developing the electrostatic image on the surface of the photoreceptor to form a toner image;

the toner replenishing apparatus of claim 1, for replenishing toner to the developing section;

a transfer section for transferring the toner image to a recording medium; and a fixing section for fixing the toner image transferred to the recording medium.

* * * * *